US005509250A

United States Patent [19]

Jensen et al.

[11] Patent Number: 5,509,250

[45] Date of Patent: Apr. 23, 1996

[54] STRUCTURAL PANEL USEFUL FOR SKYLIGHTS

[75] Inventors: Randall A. Jensen; Jeffrey Burgardt, both of Indianapolia, Ind.

[73] Assignee: Skylights, Incorporated, Mooresville, Ind.

[21] Appl. No.: 123,875

[22] Filed: Sep. 20, 1993

[51] Int. Cl.[6] ..... E04C 2/54

[52] U.S. Cl. ..... 52/200; 52/780; 52/729.1; 52/786.13

[58] Field of Search ..... 52/786, 729, 720, 52/775, 780, 490, 479, 821, 829, 785, 788, 790, 810

[56] References Cited

U.S. PATENT DOCUMENTS

| | | | |
|---|---|---|---|
| 3,203,151 | 8/1965 | Bransford, Jr. | 52/729 |
| 3,276,177 | 10/1966 | Keller | 52/311.1 |
| 3,509,669 | 5/1970 | Plemeng | 52/729 |
| 3,886,706 | 6/1975 | Baker . | |
| 3,967,423 | 7/1976 | Hammond . | |
| 4,453,363 | 6/1984 | Koller | 52/729 |
| 4,471,584 | 9/1984 | Dietrich . | |
| 4,507,901 | 4/1985 | Carroll | 52/729 |
| 4,567,710 | 2/1986 | Reed | 52/790 |
| 4,675,060 | 6/1987 | Schnebly et al. . | |
| 4,703,596 | 11/1987 | Sandow . | |
| 5,003,733 | 4/1991 | Strobl, Jr. et al. | 52/780 |

*Primary Examiner*—Carl D. Friedman
*Assistant Examiner*—Wynn E. Wood
*Attorney, Agent, or Firm*—Woodard, Emhardt, Naughton, Moriarty & McNett

[57] ABSTRACT

Described is a preferred structural panel including a frame and elongate members movably engaged by edges of the frame. Sheet material is bonded to the movably engaged elongate members and covers each side of the frame. In this manner, differential expansion among components of the frame and the sheet material can be accommodated by movement of the elongate members. Also described are preferred sheet material support systems and I-beam members.

33 Claims, 7 Drawing Sheets

STRUCTURAL PANEL USEFUL FOR SKYLIGHTS

BACKGROUND OF THE INVENTION

The present invention relatives generally to structural panel systems used as building components, and more particularly to structural panels useful in constructing translucent or transparent wall structures such as those used in skylight systems. Panels of the invention have a unique composite construction providing improved panel integrity especially wherein components of the panel are constructed of materials having differing coefficients of thermal expansion.

As further background to the invention, translucent and/or transparent wall systems, such as those used in skylights, have long been used in the building industry to provide a esthetic value and illuminate interiors of buildings. Such systems typically have a metal gridwork and, received in the gridwork, a plurality of translucent or transparent panels. Historically, these panels have been constructed having a metal frame such as aluminium, each side of which is covered by a facing material. In turn, the facing material has historically often been constructed of a non-metal material, such as fiberglass or plastic, most notably in industry fiberglass, which has been bonded to the metal frame.

A problem encountered with such panel constructions is that the materials of the frame and the facing often have differing coefficients of thermal expansion. When this is the case, differential expansion of the frame and facing create stress on the bonds between them and) where the facing has a greater coefficient of thermal expansion, can cause the facing to become rounded or "pillowed" when subjected to heat.

U.S. Pat. No. 3,967,423 to Hammond is illustrative of such systems having the facing bonded directly to the panel frame. Particularly, the Hammond patent describes a skylight panel comprised of an extruded aluminium frame of rectangular outline. The panel of Hammond is closed on both sides by translucent facing which is made of a tough, durable plastic bonded at the margins to the outer edges of the frame.

U.S. Pat. No. 3,886,706 to Baker describes building sandwich panels having facing panels removably supported on a load-carrying frame. The removable support facilitates assembly at a building site and repair thereafter.

In light of the background in the area, there is a need and demand for improved panel constructions overcoming difficulties presented by prior constructions. The applicants' invention addresses this need.

SUMMARY OF THE INVENTION

Accordingly, briefly describing one preferred embodiment of the invention, provided is a novel structural panel that can be used to form skylight systems or the like. The structural panel of the invention comprises a plurality of elongate members (e.g. beams) defining a panel frame. Each of the elongate members of the panel frame includes first and second edges, and the first and second edges each define a channel. The panel also includes elongate infill members movably engaged by the channels and having first portions received in the channels and second portions exterior of the channels. The second portions provide bonding surfaces on first and second sides of the panel frame. The panel further includes sheet material bonded to the bonding surfaces and covering the first and second sides of the panel frame.

Another preferred embodiment of the invention provides a skylight system which includes a plurality of generally right-angularly related frame elements defining a plurality of bays for receiving structural panels, and a plurality of structural panels received in the bays. The structural panels each include a plurality of elongate members defining a panel frame wherein each of the members has first and second edges each defining an elongate channel. The structural panel further includes elongate infill members movably engaged by the channels, wherein the infill members have first portions received in the channels and second portions exterior of the channels, the second portions providing bonding surfaces on first and second sides of the panel frame. The panels further include translucent or transparent sheet material bonded to the bonding surfaces and covering the first and second sides of the panel frame.

Another preferred embodiment of the invention provides a sheet material support system for a structural panel which includes an elongate member having a first edge having a channel defined therein. A first elongate infill member is movably engaged by the channel, and has a first portion received in the channel and a second portion exterior of the channel providing a bonding surface generally along the edge of the member. Sheet material is bonded to the bonding surface of the elongate infill member.

Another preferred embodiment of the invention provides an I-beam comprising an elongate beam having a web portion interconnecting first and second edges of the beam. First and second channels are defined in the first and second edges, respectively, each channel having a wider portion and a narrower portion, wherein the wider portion occurs intermediate the narrower portion and the web portion whereby each channel is adapted to engage an infill member having corresponding wider and narrower portions.

Still another preferred embodiment of the invention provides a structural panel which comprises a plurality of metal elongate members defining a panel frame. Each of the members includes a first and a second edge. The panel also includes plastic elongate members movably engaged by the edges of the metal elongate members and providing bonding surfaces on first and second sides of the panel frame. The structural panel further includes plastic sheet material bonded to the bonding surfaces of the plastic elongate members and covering the first and second sides of the panel frame.

It is an object of the present invention to provide a structural panel of advantageous integrity when subjected to varying thermal conditions.

Another object of the invention is to provide a sheet material support system for a structural panel in which the sheet material is supported on the panel in a fashion so as to reduce or eliminate pillowing of the sheet material under heat conditions, and to reduce forces applied to the bond participating in the support of the sheet material to the panel frame.

Another object of the present invention is to provide a skylight system including a plurality of structural panels of the invention which has improved integrity and appearance when subjected to varying thermal conditions.

It is a further object of the invention to provide a structural panel and a skylight system including a plurality of the structural panels which are readily constructed while also having the above-noted advantages.

Additional objects, features and advantages of the invention will be apparent from the following description.

DESCRIPTION OF THE PREFERRED EMBODIMENT

Figure 1:
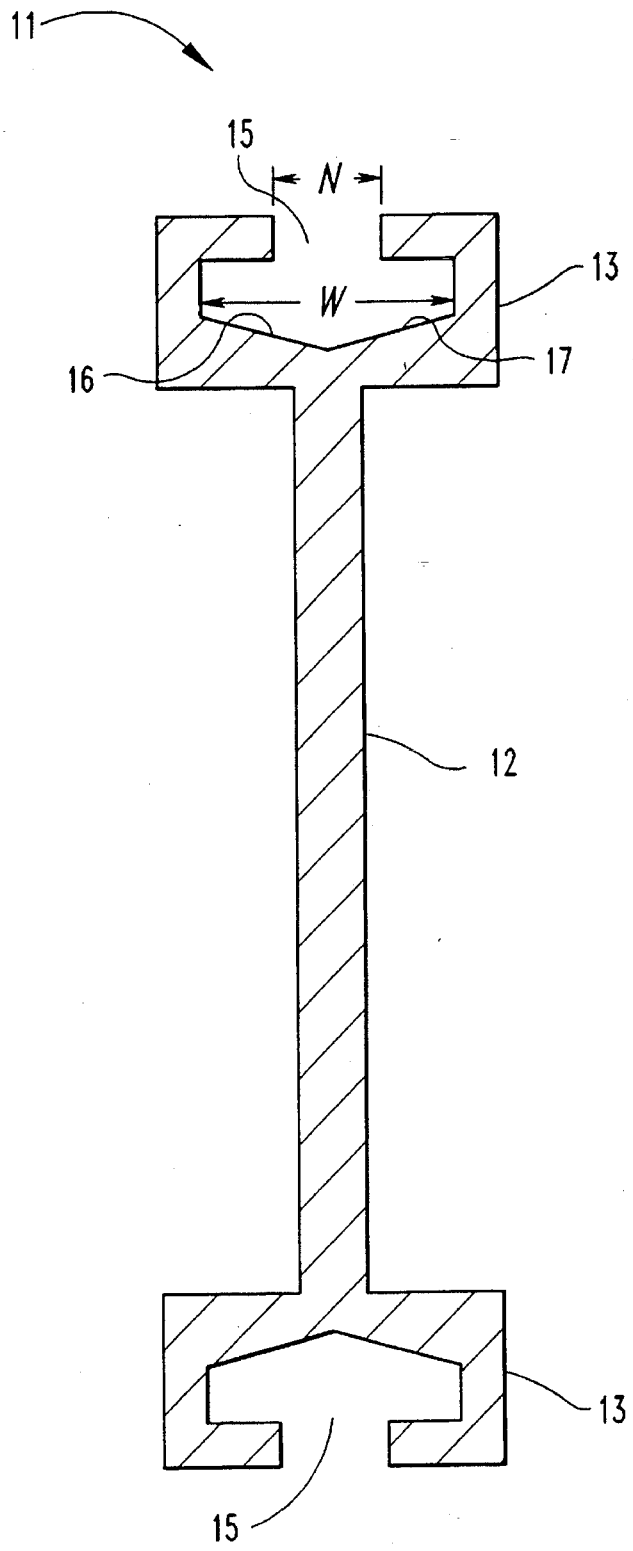
FIG. 1 provides a cross-sectional view of an I-beam in accordance with the invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

As indicated previously, the present invention provides novel structural panels, sheet material support systems, skylight systems, I-beams, and other components useful in skylight systems.

Referring now to FIG. 1, shown is a preferred I-beam 11 in accordance with the invention, I-beam 11 includes web portion 12 interconnecting ends 13 of I-beam 11. Ends 13 of I-beam 11 each define a channel 15 for receiving an infill member as discussed further below. Each channel 15 has a wider portion "W" and a narrower portion "N" for receiving corresponding wider and narrower portions of the infill member. Further, innermost portions of channel 15 have converging walls 16 and 17 which together form a trench. Such trench configurations are advantageous in providing superior point loading characteristics to panels incorporating the I-beam 11. I-beam 11 is preferably formed from an extruded metal, especially aluminium, and can vary in length in accordance with the dimensions of the structural panel contemplated.

Figure 2:
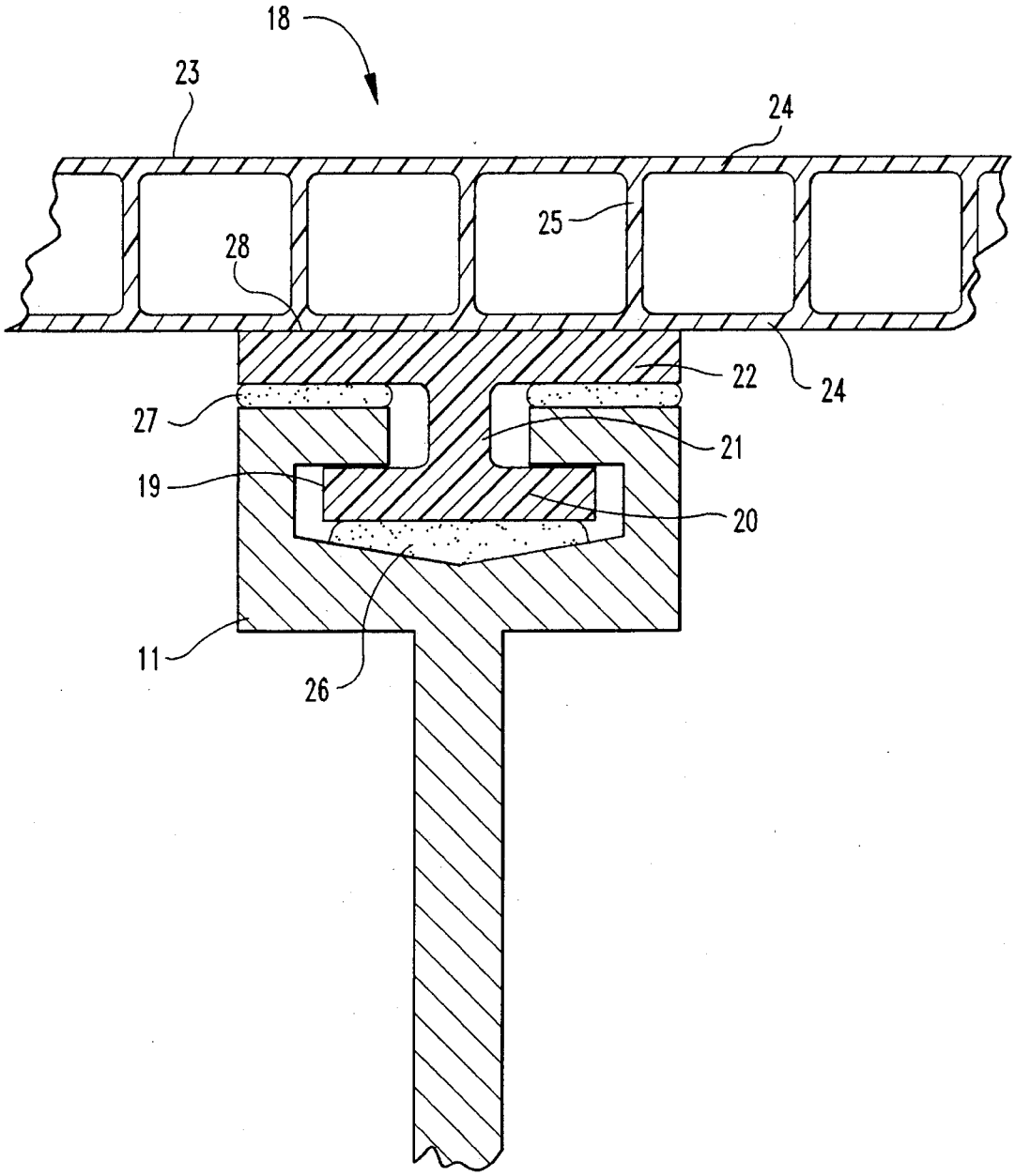
FIG. 2 provides a cross-sectional view of a sheet material support system for a structural panel in accordance with the invention FIG. 3 provides a cutaway perspective view of a structural panel in accordance with the invention.

Referring now to FIGS. 1 and 2 together, shown in FIG. 2 is a cross-sectional view of a sheet material support system 18 in accordance with the invention. It will be understood that FIG. 2 shows a break-away view of such a system, and that systems of the invention can include an identical or similar arrangement at the other end of the I-beam illustrated in FIG. 1. Sheet material support system 18 includes an I-beam 11 having a channeled end as shown in FIG. 1, an extruded infill member 19, and sheet material 23. Infill member 19 includes a relatively narrow web portion 21 interconnecting first and second wider portion 20 and 22. First wider portion 20 of infill member 19 is received in wider portion "W" of channel 15. Narrower portion 21 of infill member 19 is received in narrower portion "N" of channel 15 of I-beam 11. Second wider portion 22 of infill member 19 resides exterior of channel 15 and provides an upper surface onto which sheet material 20 can be bonded. Wider portion 20 of infill member 19 is wider than narrower portion "N" of channel 15, so that infill member 19 is engaged by channel 15. Thus, of course, when assembling I-beam and infill member 19 together, infill member 19 is positioned at the end of I-beam 11 so as to align wider portion 20 with wider portion "W" of channel 15, and infill member 19 slipped into channel 15 of I-beam 11.

Additionally, there are clearances between infill member 19 and the walls of channel 15 to allow lateral movement of infill member 19. Such lateral movement can effectively accommodate at least a portion of any differential expansion between sheet material 23 and I-beam 11. To achieve this, wider and narrower portions "W" and "N" of channel 15 are wider than corresponding wider and narrow portions 20 and 21 of infill member 19.

Preferred sheet material 23 includes two faces 24 spaced from one another. A plurality of ribs or walls 25 are transverse to and interconnect faces 24 of sheet material 23. Walls 25 may be arranged in any suitable manner. Currently in industry, walls 25 take on a number of configurations including longitudinally extending ribs, honeycomb structures, and the like. Sheet material 23 is bonded to the substantially flat or planar bonding surface 28 provided by wider portion 22 of infill member 19. Additionally, as an alternative to the structural sheet material 23, a monolithic sheet material can be used (i.e. having only a single face rather than dual faces interconnected by walls).

Preferably, sheet material 23 and infill member 19 are constructed of a suitable plastic material. More preferably, sheet material 23 and infill member 19 will be formed from the same type of plastic so as to aid in achieving a good bond therebetween. In the applicants' current most preferred embodiment, sheet material 20 and infill member 19 are formed from polycarbonate, and the bond between them is achieved using Sign-Bond adhesive available from General Electric. In this regard, suitable sheet material 23 can also be obtained commercially from General Electric under the designation Thermoclear. Sheet material 23 can be, but is not necessarily, light transmitting, that is, translucent or transparent, which is of course preferred for use in skylight systems.

Sheet material support system 18 can also include foam adhesive 26 between infill member 19 and the bottom of channel 15. Foam adhesive 27 may also be included between infill member 19 and the upper surface of I-beam 11 as illustrated. One suitable foam adhesive for these purposes is available from General Electric under the designation Sta-Bond 283. These areas of foam adhesive allow movement of the infill members while improving short term loading characteristics bosh between structural members running the length of the panel and on the structural members themselves. Further, the foam adhesive may act as an effective isolator from vibrations of sound via direct transfer.

Figure 3:
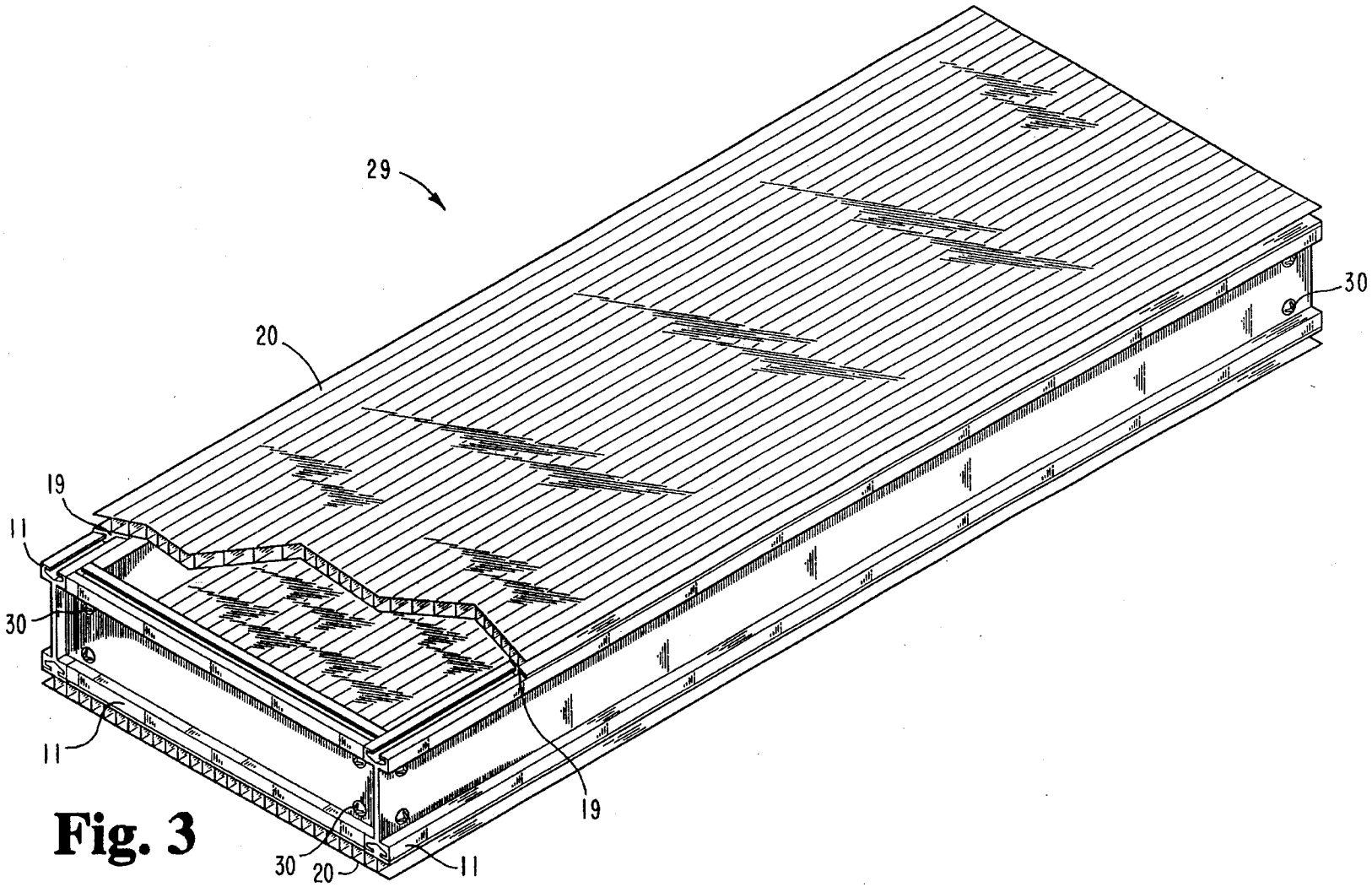

Referring now to FIG. 3, shown is a perspective view of a structural panel 29 in accordance with the invention. Structural panel 29 includes a generally rectangular frame formed from a plurality of channelled I-beams 11 of the invention secured in coplanar relationship. Such securement can be achieved, for example, using an "L" shaped corner piece having 2 legs at 90° relative to one another. The corner piece is situated either on the inside or on the outside of 2 I-beams 11 where they abut at a 90° angle, and screws 30 are inserted through the web of I-beam 11 and into the corner piece thereby securing the I-beams 11 in the substantially 90° angle relative to one another. In the illustrated panel 29, the corner pieces are situated internally in the panel and thus the screws 30, but not the corner pieces, are shown. As can be seen, I-beams 11 form the generally rectangular frame while infill members 19 traverse the channels in I-beams 11 substantially along their entire lengths. In this regard, infill members 19 are preferably cut to a length slightly shorter than the I-beams in which they are received, to accommodate expansion of infill members 19.

Sheet material 23 is bonded to bonding surfaces provided by infill members 19 and covers both sides of the panel 29. Sheet material 20 can be bonded to infill members 19 on each of the four edges of panel 29. However, in one preferred embodiment, sheet material 20 can be left unbonded along at least one of the edges to further accommodate expansion of the sheet material while avoiding pillowing.

Figure 4:
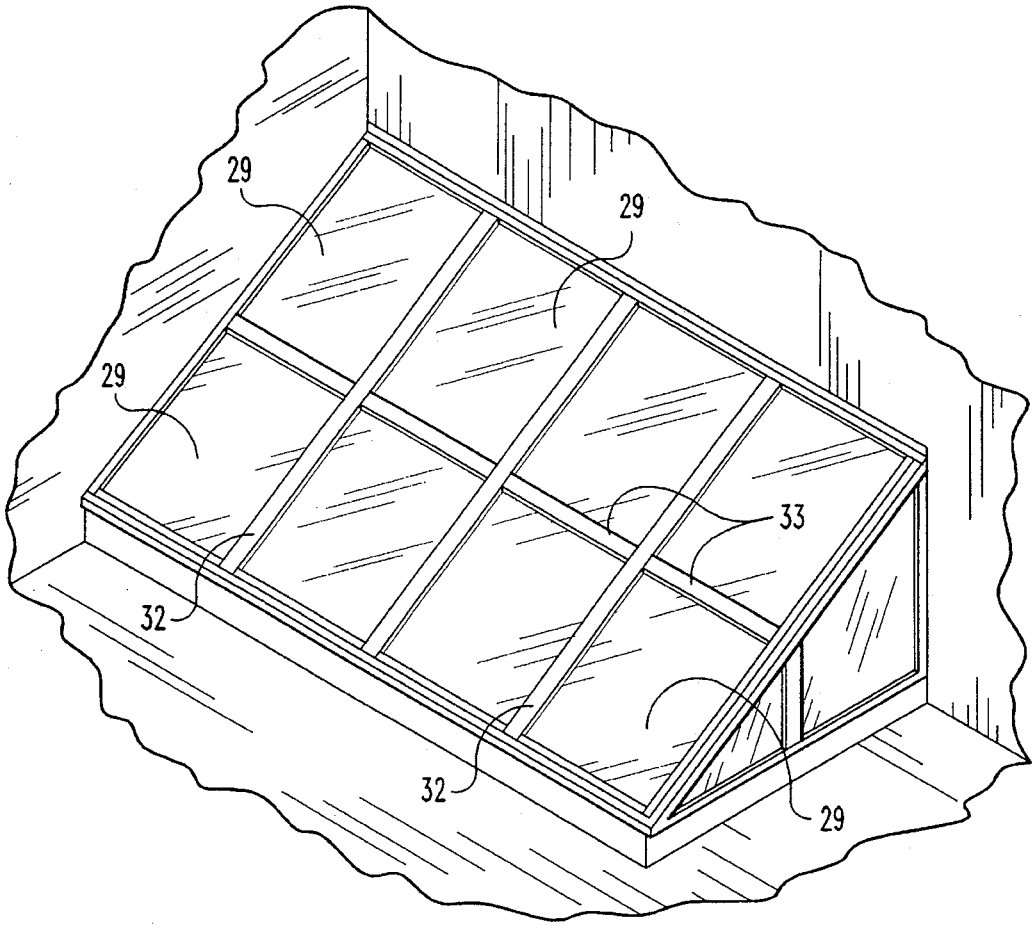
FIG. 4 provides a perspective view of a skylight system in accordance with the invention incorporating a plurality of structural panels.

Referring now to FIG. 4, shown is a perspective view of a skylight system incorporating a plurality of panels 29 of the invention. It will be understood that structural panels 29 of the invention can be made to any suitable size or shape to suit a particular application. Thus, illustrated in FIG. 4 are substantially square panels 29, whereas FIG. 3 illustrates a more elongate rectangular panel. A skylight system as depicted in FIG. 4 covers a hole in the roof of a building structure, and thus where panels 29 are constructed with translucent or transparent sheet material, illumination is provided to the interior of the building. The skylight system depicted in FIG. 4 includes a plurality of rafter arrangements, generally indicated at 32, and a plurality of horizontal arrangements, generally indicated at 33. These horizontal and rafter arrangements conventionally provide a frame having a plurality of bays in which the structural panels 29 are received. In this regard, panels of the invention can be incorporated into any conventional or otherwise suitable support system for skylights, and those skilled in the art will be readily able to achieve the same without any undue burden.

Figure 5:
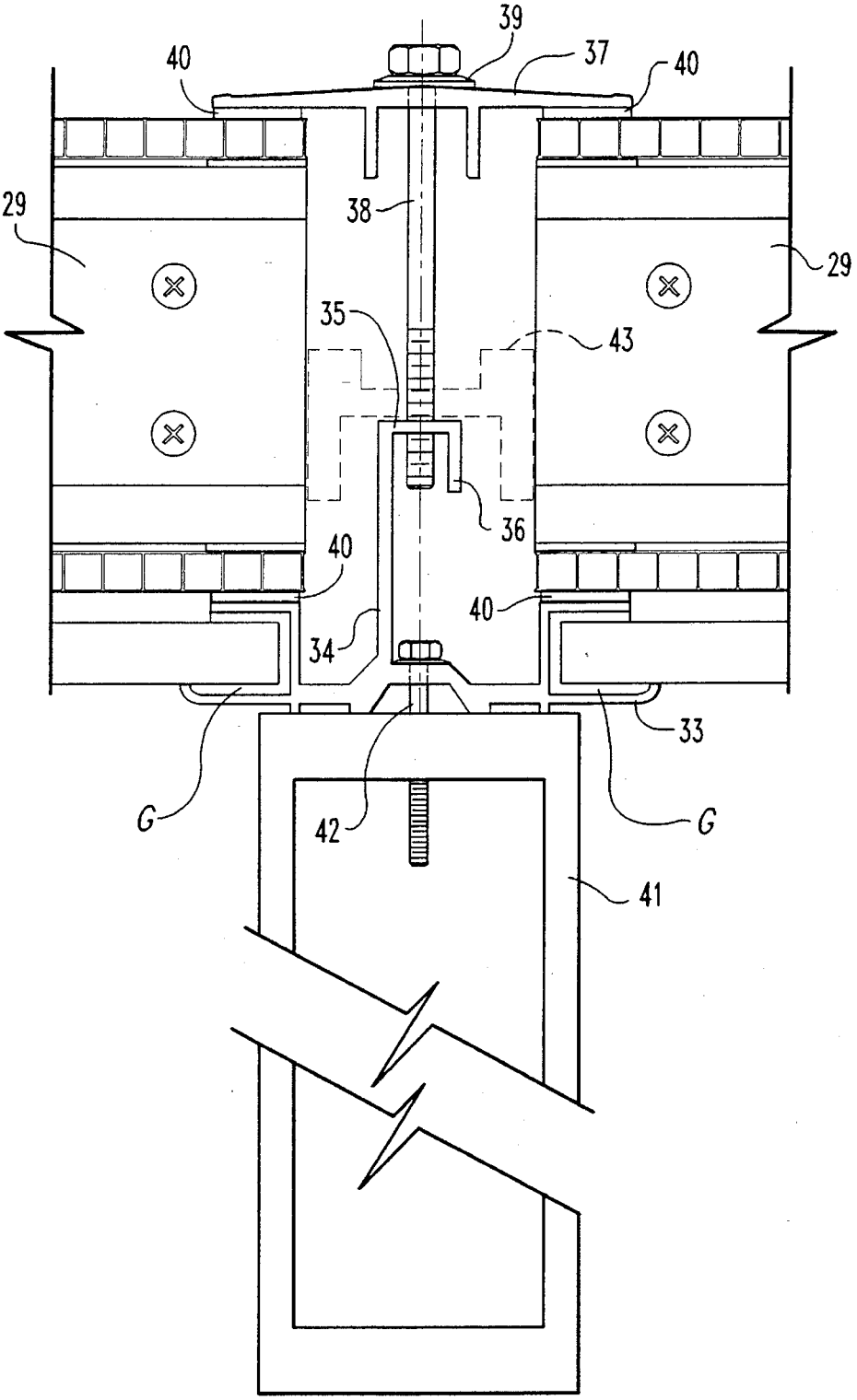
FIG. 5 provides a detail of an illustrative rafter arrangement incorporated in a skylight system of the invention.

Referring now to FIG. 5, shown is an illustrative rafter arrangement that can be incorporated into a skylight system in conjunction With structural panels 29. The rafter arrangement includes rafter member 33 situated at the bottom sides of and traversing the space between two adjacent panels 29 in substantially coplanar relationship. Rafter member 33 is preferably formed from an extruded metal such as aluminium and has arm 34 extending upwardly between panels 29. Arm 34 terminates at horizontal member 35 which in turn terminates at downwardly extending member 36.

The rafter arrangement also includes rafter compression bar 37 situated atop and traversing the space between the two panels 29. Compression bar 37 is also desirably formed from extruded metal such as aluminium. Screw or bolt 38 extends through rafter compression bar 37 (preferably provided with washer 39 between the hex head of bolt 38 and compression bar 37) and down through horizontal member 35 of rafter member 33. In this manner, screw or bolt 38 can be threaded further into or out of horizontal member 35 to apply or relieve compression of the two panels 29 between rafter member 33 and compression bar 37.

Butyl tape 40 or another compressible material is preferably provided on the surfaces of panels 29 which are overlapped by compression bar 37 and rafter member 33. Butyl tape 40 thus assists in forming a seal between panels 29 and compression bar 37 and rafter member 33.

For skylight systems that Cover large expanses, each rafter member 33 can be attached to a tube member 41 traversing the expanse to provide a load supporting frame. This attachment can be achieved, for example, by screw or bolt 42 extending through rafter member 33 and into tube 41. For small expanses, tube members 41 will be unnecessary. The rafter arrangement can also include a flexible block of material 43 (e.g. formed from rubber or a similar material) snugly fitted between the two panels 29 to assist in maintaining proper spacing of the panels 29. The block 43 is preferably "H"-shaped and is supported on horizontal member 35 of rafter member 33.

Figure 6:
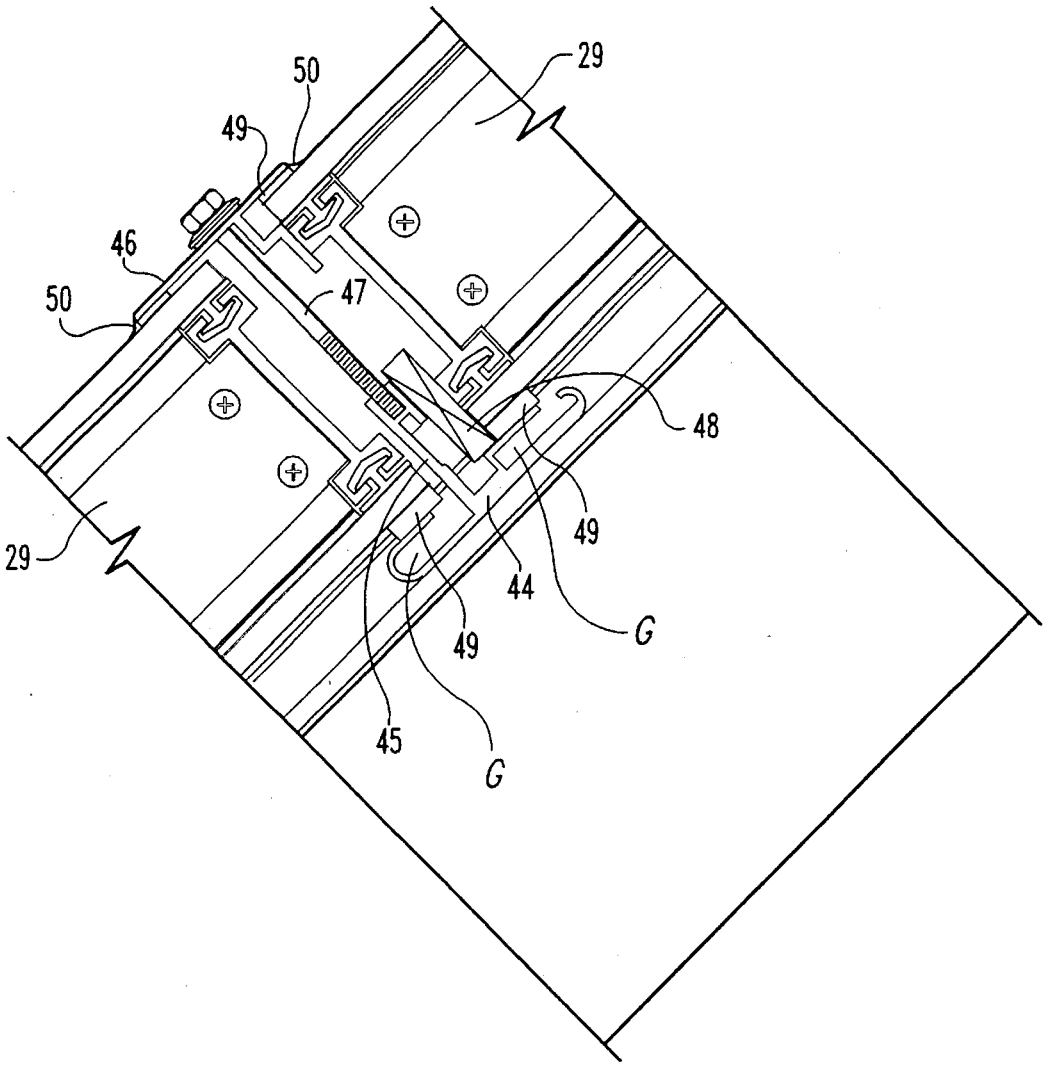
FIG. 6 provides a detail of an illustrative horizontal arrangement incorporated in a skylight system of the invention.

Referring now to FIG. 6, shown is a typical horizontal arrangement which can be incorporated into a skylight system in conjunction with structural panels 29. The horizontal arrangement includes horizontal member 44, preferably formed from extruded aluminium, situated beneath and spanning the space between the two adjacent structural panels 29. Horizontal member 44 includes arm 45 extending upwardly between structural panels 29. The horizontal arrangement further includes horizontal compression bar 46 (preferably extruded aluminium). Bolt 47 extends through horizontal compression bar 46 (preferably with washer as illustrated) and into a screw boss provided at the end of arm 45 of horizontal member 44 as illustrated. In this manner, similar to the rafter arrangement previously discussed, bolt 47 can be threaded further into or out of the screw boss to apply or relieve compression of the panels 29. Spacer member 48, preferably made of a compressible material such as rubber, is situated between arm 45 of horizontal member 44 and panel 29 (upper right) situated at an elevation above horizontal member 44. Spacer member 48 thus assists in maintaining proper alignment of structural panel 29.

Again similar to that found in the rafter arrangement, butyl tape 49 or a similar compressible material is desirably provided on the the outer surfaces of structural panels 29 which are overlapped by horizontal member 44 and horizontal compression bar 46. Additionally, a bead of sealant 50 is provided at the edges of horizontal compression bar 46 to prevent water migration into the horizontal arrangement.

As indicated, the horizontal and vertical arrangements provide a plurality of bays for receiving structural panels. In the arrangements described above, it should be noted that the structural panels 29 are retained in the bays by friction fit so as to allow movement of sheet material 23 relative to compression bars 37 and 46 and rafter and horizontal members 33 and 44. This contributes to ameliorating pillowing of sheet material 23 as it expands.

It should also be noted that skylight systems can conventionally incorporate horizontal and/or verticle guttering systems. In the rafter and horizontal arrangements of FIGS. 5 and 6, these gutters "G" are provided by the specific configurations of rafter member 33 and horizontal member 44, as illustrated.

Figure 7:
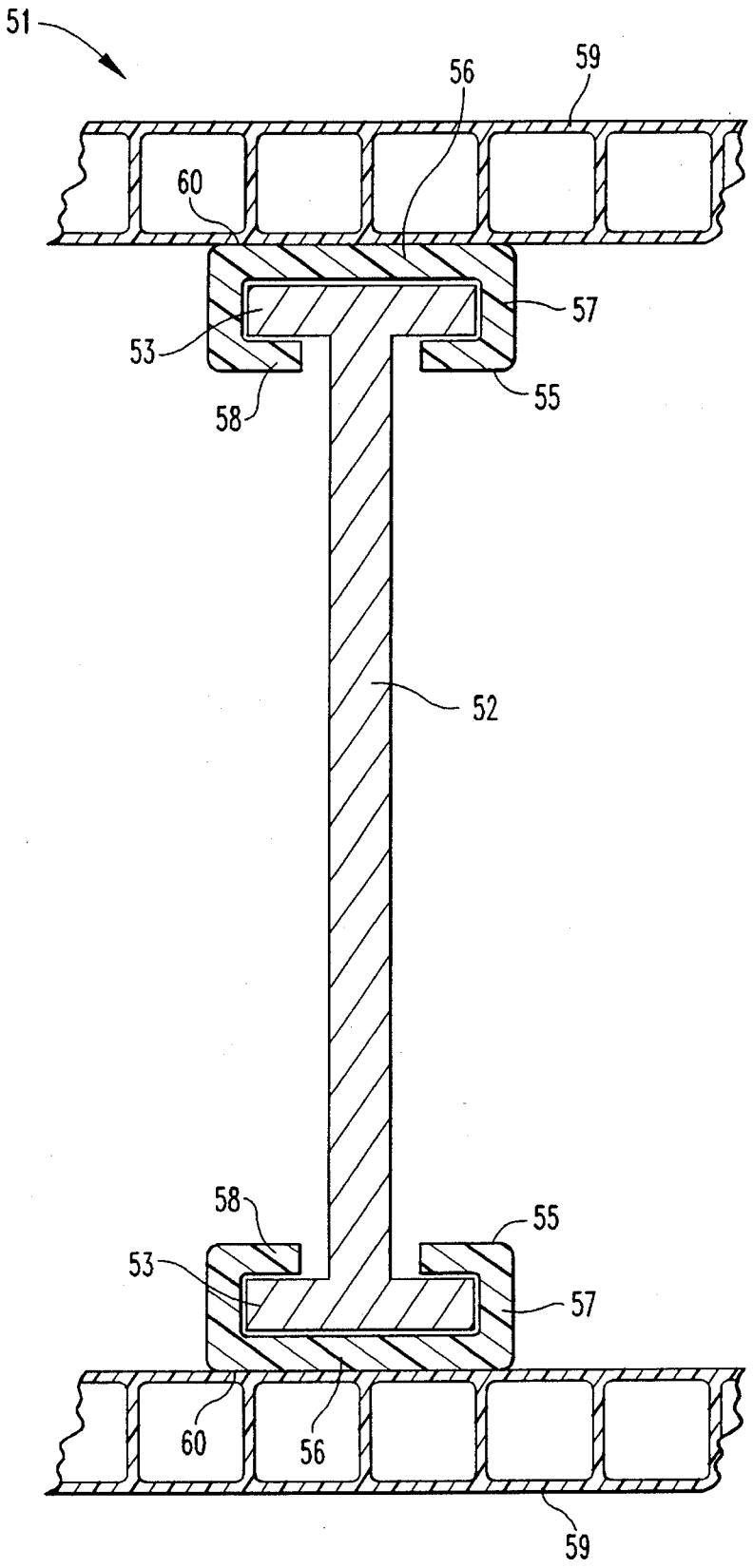
FIG. 7 provides an alternative sheet material support system for a structural panel in accordance with the invention.

Referring now to FIG. 7, shown in an alternative sheet material support system 51 in accordance with the invention. System 51 includes I-beam 52 having ends 53. I-beam 52 is preferably made of an extruded metal such as aluminium. System 51 further includes cap members 55 engaged by ends 53 of I-beam 52. To achieve this engagement, cap member 55 has arms 56, 57 and 58 which together form a channel which receives and engages horizontal arms of I-beam ends 53. Sheet material 59 is bonded to bonding surface 60 provided by cap member 55. In this manner, cap member 55 is movably engaged by I-beam ends 53 such that differential expansion of I-beam 52 and sheet material 59 can be accommodated and the forces applied to the bond between sheet material 59 and bonding surface 60 reduced. Cap member 55 and sheet material 59 are preferably formed from extruded plastic such as extruded polycarbonate resin.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A structural panel comprising:

a plurality of elongate members defining a panel frame having first and second sides;

each of said elongate members having first and second elongate edges, said first and second edges each having a channel defined therein;

elongate infill members movably engaged by said channels, said infill members having first portions received in said channels with clearances provided between said first portions and said channels, said infill members further having, second portions exterior of said channels, said second portions providing bonding surfaces on first and second sides of said panel frame;

sheet material bonded to said bonding surfaces of said elongate infill members and covering said first and second sides of said panel frame;

said elongate members and said sheet material having differing coefficients of thermal expansion, wherein differential expansion of said elongate members and sheet material causes said infill members to move within said channels.

2. The structural panel of claim 1, wherein: said second portions of said infill members provide flat bonding surfaces.

3. The structural panel off claim 1 wherein: said elongate members are each a beam including a web portion interconnecting said first and second edges.

4. The structural panel of claim 3, wherein:

said elongate channels each have a relatively wide portion and a relatively narrow portion, said wide port,on being intermediate said narrow portion and said web; and said infill members each halve two relatively wide portions and a relatively narrow portion intermediate said wide portions;

said narrow portions of said infill members being received in said narrow portions of said channels;

one of said wide portions of said infill members being received by said wide portion of said channel; and the other of said wide portions of said infill members residing exterior of said channels and providing substantially planar bonding surfaces.

5. The structural panel of claim 3, wherein:

said beams are formed from extruded metal; and said infill members and sheet material are formed from plastic.

6. The structural panel of claim 5 wherein:

said sheet material and infill members are formed from the same plastic.

7. The structural panel of claim 5, wherein:

said infill members have a coefficient of thermal expansion substantially identical to that of said sheet material; and wherein said clearances allow lateral movement of said infill members.

8. The structural panel of claim 7, wherein:

said elongate members are formed from extruded aluminum.

9. The structural panel of claim 8, wherein:

said infill members are formed from polycarbonate.

10. The structural panel of claim 9, wherein:

said sheet material is formed from polycarbonate.

11. The structural panel of claim 10, wherein:

said sheet material is translucent or transparent.

12. The structural panel of claim 11, wherein;

said sheet material has first and second faces spaced from one another and interconnected by transverse wall members.

13. A skylight system, comprising:

a frame including a plurality of generally right-angularly related frame elements defining a plurality of generally rectangular bays for receiving structural panels;

a plurality of structural panels received in said bays;

said structural panels each including a plurality of elongate members defining a panel frame having first and second sides, each of said elongate members having first and second edges each defining an elongate channel;

elongate infill members movably engaged by said channels, said infill members having first portions received in said channels with clearances provided between said first portions and said channels, said infill members further having second portions exterior of said channels, said second portions providing bonding surfaces on first and second sides of said panel frame;

translucent or transparent sheet material bonded to said bonding surfaces of said elongate infill members and covering said first and second sides of said panel frame;

said sheet material and said elongate members having differing coefficients of thermal expansion, wherein differential expansion of said elongate members and sheet material causes said infill members to move within said channels.

14. The skylight system of claim 13, wherein:

said second portions of said infill members provide flat bonding surfaces for said sheet material.

15. The skylight system of claim 13, wherein:

said elongate members each including a web portion interconnecting said first and second edges.

16. The skylight system of claim 15, wherein:

said elongate channels each have a relatively wide portion and a relatively narrow portion, said wide portion being intermediate said narrow portion and said web; and said infill members each have two relatively wide portions and a relatively narrow portion intermediate said wide portions;

said narrow portions of said infill members being received in said narrow portions of said channels;

one of said wide portions of said infill members being received by said wide portion of said channel; and the other of said wide portions of said infill members residing exterior of said channels and providing flat bonding surfaces.

17. The skylight system of claim 16, wherein:

said elongate members are formed from extruded metal; and said infill members are formed from plastic.

18. The skylight system of claim 17, wherein:

said infill members have a coefficient of thermal expansion substantially identical to that of said sheet material;

said panels are received in said bays so as to allow movement of said sheet material as it expands;

whereby differential expansion of said beams and sheet material causes said infill members to move within said channels.

19. The skylight system of claim 18, wherein:

said elongate members are formed from extruded aluminum.

20. The skylight system of claim 19, wherein:

said infill members are formed from polycarbonate.

21. The skylight system of claim 20, wherein:

said sheet material is formed from polycarbonate.

22. The skylight system of claim 21, wherein;

said sheet material has first and second faces spaced from one another and interconnected by transverse wall members.

23. A sheet material support system, comprising:

an elongate beam having a web portion and a first edge connected to said web portion, said first edge having a channel defined therein;

a first elongate infill member movably engaged by said channel, said first elongate infill member having a first portion received in said channel with clearances provided between said first portions and said channels, said infill member further having, a second portion exterior of said channel and providing a bonding surface generally along the first edge of said beam; and sheet material bonded to said bonding surface of said first elongate infill member;

said elongate beam and said sheet material having differing coefficients of thermal expansion, wherein differential expansion of said elongate beam and sheet material causes said infill members to move within said channel.

24. The sheet material support system of claim 23, wherein:

said elongate channel of said beam has a relatively wide portion and a relatively narrow portion, said wide portion being intermediate said narrow portion and said web; and said infill member having two relatively wide portions and a relatively narrow portion intermediate said wide portions;

said narrow portion of said infill member being received in said narrow portion of said channel;

one of said wide portions of said infill member being received by said wide portion of said channel; and the other of said wide portions of said infill member residing exterior of said channel and providing a substantially planar bonding surface for said sheet material.

25. The sheet material support system of claim 24, wherein:

said beam is formed from extruded metal; and said infill member is formed from plastic.

26. The sheet material support system of claim 25, wherein:

said infill member has a coefficient of thermal expansion substantially identical to that of said sheet material.

27. The sheet material support system of claim 24, wherein:

said beam is formed from extruded aluminum.

28. The sheet material support system of claim 27, wherein:

said infill members are formed from extruded polycarbonate.

29. The sheet material support system of claim 28, wherein:

said sheet material is formed from polycarbonate.

30. The sheet material support system of claim 29, wherein:

said infill member is formed from polycarbonate.

31. An I-beam, comprising:

an elongate beam having a web portion interconnecting first and second edges of the beam;

first and second channels defined in said first and second edges, respectively;

each said channel including a wider portion and a narrower portion, said wider portion occurring intermediate said narrower portion and said web portion, whereby each said channel is adapted to engage an infill member having corresponding wider and narrower portions;

said wider portion further including first and second side walls and an innermost portion, said innermost portion being formed from two converging walls which together form a trench generally centrally located in said innermost portion and aligned with said web portion.

32. The I-beam of claim 31, which is formed from extruded aluminum.

33. A structural panel, comprising:

a plurality of metal elongate members defining a panel frame having first and second sides, each of said elongate members including a first and a second edge;

plastic elongate members movably engaged by the edges of said metal elongate members, said movable engagement being provided by clearances provided between engaged portions of said elongate members and said edges, said elongate members further providing bonding surfaces on first and second sides of said panel frame; and plastic sheet material bonded to the bonding surfaces of said plastic elongate members and covering the first and second sides of said panel frame;

said metal elongate members and said plastic sheet material having differing coefficients of thermal expansion, wherein differential expansion of said metal elongate members and plastic sheet material causes said plastic elongate members to move along the edges of said metal elongate members.

* * * * *